US010240403B2

(12) United States Patent
Gratzinger et al.

(10) Patent No.: US 10,240,403 B2
(45) Date of Patent: Mar. 26, 2019

(54) OPPOSING THREAD SCREW SAFETY JOINT

(71) Applicant: Schlumberger Technology Corporation, Sugar Land, TX (US)

(72) Inventors: Michael Joseph Gratzinger, Houston, TX (US); Brian John Bethscheider, Alvin, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 313 days.

(21) Appl. No.: 15/102,239

(22) PCT Filed: Dec. 5, 2014

(86) PCT No.: PCT/US2014/068700
§ 371 (c)(1),
(2) Date: Jun. 6, 2016

(87) PCT Pub. No.: WO2015/085125
PCT Pub. Date: Jun. 11, 2015

(65) Prior Publication Data

US 2016/0305196 A1 Oct. 20, 2016

Related U.S. Application Data

(60) Provisional application No. 61/912,611, filed on Dec. 6, 2013.

(51) Int. Cl.
*E21B 17/042* (2006.01)
*E21B 17/06* (2006.01)
*E21B 31/00* (2006.01)

(52) U.S. Cl.
CPC ..... *E21B 17/06* (2013.01); *E21B 17/0423* (2013.01); *E21B 31/00* (2013.01)

(58) Field of Classification Search
CPC ..... E21B 17/0423; E21B 17/06; E21B 31/00; E21B 17/042
See application file for complete search history.

(56) References Cited

U.S. PATENT DOCUMENTS 2,163,212 A * 6/1939 Reddick ..... E21B 17/042 285/12
4,688,832 A * 8/1987 Ortloff ..... E21B 17/0423 285/148.19

(Continued)

FOREIGN PATENT DOCUMENTS

EP 0928361 B1 2/2004

OTHER PUBLICATIONS

International Search Report and Written Opinion of International Patent Application No. PCT/US2014/068700 dated Mar. 27, 2015, 9 pages.

(Continued)

*Primary Examiner* — Daniel P Stephenson

(57) ABSTRACT

Embodiments may generally take the form of a safety joint and methods related thereto. One embodiment may take the form of a safety joint deployable in a well. The safety joint includes a first sub and a second sub coupled to the first sub. The coupling of the two subs may include a first set of threads having a first orientation and a second set of threads having a second orientation different from the first set of threads. The first sub is decoupleable from the second sub upon disengagement of the first set of threads by rotation in a first direction followed by disengagement of the second set of threads by rotation in a direction opposite from the first direction.

15 Claims, 5 Drawing Sheets

(56) References Cited

U.S. PATENT DOCUMENTS

| | | | | |
|---|---|---|---|---|
| 6,279,962 | B1 * | 8/2001 | McGarian | E21B 17/06 175/320 |
| 7,654,316 | B2 * | 2/2010 | Telfer | E21B 17/042 166/242.6 |
| 8,561,692 | B1 * | 10/2013 | Schultz | E21B 17/06 166/242.6 |
| 2003/0067169 | A1 * | 4/2003 | Church | E21B 17/042 285/334 |
| 2004/0188086 | A1 | 9/2004 | McGarian et al. | |
| 2009/0242213 | A1 | 10/2009 | Braddick | |
| 2011/0232895 | A1 * | 9/2011 | Klotz | E21B 33/04 166/77.51 |
| 2013/0233566 | A1 | 9/2013 | Ringgenberg | |
| 2013/0319655 | A1 | 12/2013 | Schultz et al. | |
| 2016/0160575 | A1 * | 6/2016 | Hou | E21B 17/0423 285/334 |
| 2016/0208962 | A1 * | 7/2016 | Sugino | F16L 15/004 |
| 2016/0305196 | A1 * | 10/2016 | Gratzinger | E21B 17/06 |
| 2017/0254156 | A1 * | 9/2017 | Aguilar Mendez | E21B 17/042 |
| 2017/0328414 | A1 * | 11/2017 | Sadabadi | F16D 1/116 |
| 2018/0106114 | A1 * | 4/2018 | Shampine | E21B 17/042 |

OTHER PUBLICATIONS

International Preliminary Report on Patentability of International Patent Application No. PCT/US2014/068700 dated Jun. 16, 6 pages.

* cited by examiner

OPPOSING THREAD SCREW SAFETY JOINT

BACKGROUND

Hydrocarbon fluids such as oil and natural gas are obtained from a subterranean geologic formation, referred to as a reservoir, by drilling a well that penetrates the hydrocarbon-bearing formation. Commonly, a test string may be run in-hole with various different tools and components coupled to it to perform various downhole tasks. Occasionally, the test string may become stuck in the well and the string is unable to be retrieved. Safety joints have been developed to release the string above the point at which the string is stuck. Example safety joints have utilized shear screws, left hand turn, or right hand turn release techniques. More complicated safety joints may incorporate an overpull being applied for a specified amount of time until a crushable element is deformed and the tool releases. In addition, safety joints exist in which the tool is picked up to release a sleeve and then left hand turns will release the tool. Lastly, some safety joints utilize a J-slot.

SUMMARY

Embodiments may generally take the form of a safety joint and methods related thereto. One embodiment may take the form of a safety joint deployable in a well. The safety joint includes a first sub and a second sub coupled to the first sub. The coupling of the two subs may include a first set of threads having a first orientation and a second set of threads having a second orientation different from the first set of threads. The first sub is decoupleable from the second sub upon disengagement of the first set of threads by rotation in a first direction followed by disengagement of the second set of threads by rotation in a direction opposite from the first direction. Another embodiment may take the form of method including uncoupling a safety joint. The uncoupling may include rotating a first sub of the safety joint in a first direction to detach a first set of threads and displacing the first sub longitudinally relative to a second sub of the safety joint. Further, the decoupling may include engaging a second set of threads and rotating the first sub in a second direction opposite of the first direction to detach the second set of threads.

Figure 1:
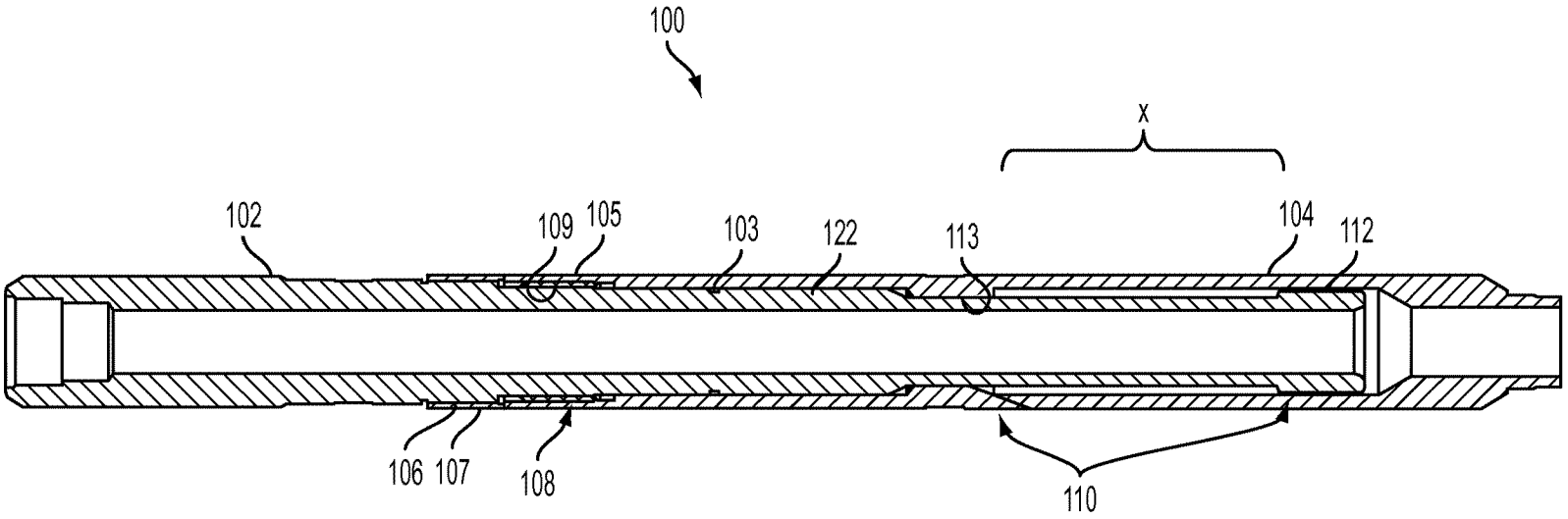
FIG. 1 is a cross-sectional view of a safety joint in a run in hole configuration in accordance with an example embodiment.

Certain embodiments of the disclosure will hereafter be described with reference to the accompanying drawings, wherein like reference numerals denote like elements. It should be understood, however, that the accompanying drawings illustrate only the various implementations described herein and are not meant to limit the scope of various technologies described herein. The drawings show and describe various embodiments of the current disclosure.

DETAILED DESCRIPTION

In the following description, numerous details are set forth to provide an understanding of the present disclosure. However, it will be understood by those skilled in the art that the embodiments of the present disclosure may be practiced without these details and that numerous variations or modifications from the described embodiments may be possible.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the disclosure.

A bottom hole assembly (BHA) may become stuck, for example, when the perforating guns or packer have engage the sidewalls of the well thereby preventing the string from being pulled out of hole and also preventing free rotation of the BHA. Because the BHA is unable to rotate, torque may be applied to the safety joint to disengage the tool string when a point below it becomes stuck.

Embodiments may take the form of a downhole safety joint usable during well test and well intervention operations. Specifically, embodiments of the safety joint allow for quick release from a bottom hole assembly (BHA) should the string below the safety joint become stuck.

The safety joints use multiple functions in a prescribed order for release and further include opposing threads. Present embodiments may take the form of two opposing threads, for example. The functions can be transmitted downhole through the drill pipe, as discussed further below. For example, in one embodiment, to be disengaged, the tool may be initially turned to the left, then lifted and turned to the right to release the tubing string above the safety joint. Hence, embodiments include a specific set of steps to properly disconnect the tool, reducing the likelihood of accidental release and wrong connection release. No matched machined parts or shearing devices are used and the design is simplified.

Once the tool string above the safety joint has been brought back to surface, the remaining housing (or sub) of the safety joint provides a fishing point for recovery operations. The remaining sub can be fished with, for example, an overshot or a fishing tool that matches the internal threads (e.g., right hand threads).

Turning to the drawings and referring initially to FIG. 1, a cross-sectional view of an example safety joint 100 is illustrated in a run in hole ("RIH") position. In some embodiments, the safety joint 100 or "tool" may include multiple component parts. For example, the safety joint 100 may include an upper sub 102 and a lower sub 104. A torque ring 106 may also be provided. The torque ring 106 may be coupled to the upper sub 102.

The safety joint 100 may be tubular in shape and include a hollow center through which production fluid or other fluids may be communicated. The upper sub 102 may be inserted within the lower sub 104. A sealing member 103, such as an O-ring, may be provided to create a seal between the upper and lower subs 102, 104. The safety joint 100 may be coupled in-line with a tool string, for example, that is deployed into a well. Specifically, for example, the lower sub 104 may be coupled to a BHA and the upper sub 102 may be coupled to a tubing string extending to the surface.

While the safety joint 100 is in the RIH position, a torque ring 106 with threads 107 (e.g., left hand threads) may be torqued against the lower sub 104 having opposing threads 105 (e.g., right hand threads). This allows for torque (e.g., right hand torque) to be transmitted through the string. The threads 105 may be part of a first set of threads 108 that include thread 109 of the upper sub 102. The first set of threads 108 are the first to be disconnected during disconnection.

Embodiments also include a second set of threads 110 that may include threads 112 of the upper sub 102 and threads 113 of the lower sub 104. In the RIH position, the threads 112, 113 of the second set of threads 110 are not coupled together. Rather, the threads 112, 113 are separated a distance "x". The second set of threads 110 may be oriented opposite to the orientation of the first set of threads 108. That is, for example, if the first set of threads 108 is oriented as right-handed threads, the second set of threads 110 may be oriented as left-handed threads.

The safety joint 100 may be located directly above a retrievable packer in the string in some embodiments. In some bottom hole assemblies, for example, the safety joint 100 may be positioned below a JAR. This may help increase the tools recovered when disengaging from a stuck packer or tubing conveyed perforating guns. The rotation used to operate the tool may come from either a top drive or rotary table at surface and may be transmitted via the work string.

During routine operations, a pick up weight and slack off weight may be recorded after the BHA has been run to total depth. The pick up and slack off weights may be referred to and used during the disengagement, as discussed further below. In some embodiments, to begin the disengaging process, a slack off weight may be taken after the string has been deemed stuck. The difference between the stuck slack off weight and the initial run in hole slack off weight may give an estimate of the amount of string weight supported by the stuck point. That weight difference may be subtracted from the run in hole pick up weight to determine the pickup weight of the struck string. The string may be brought to a neutral point (the calculated pick up weight of the stuck string) where little or no overpull (tension) is being applied to the string.

At the neutral point, the string may be turned (e.g., to the left) at a torque value large enough to overcome the torque of the torque ring 106 but below a torque value of the rest of the string. Once the torque ring 106 has been backed off, the remaining connection between the upper and lower subs 102, 104 may be the loosest connection in the string, as they are not shouldered. Turning the upper sub 102 a set number of turns in a first direction (e.g., to the left) disengages the first set of threads 108.

Figure 2:
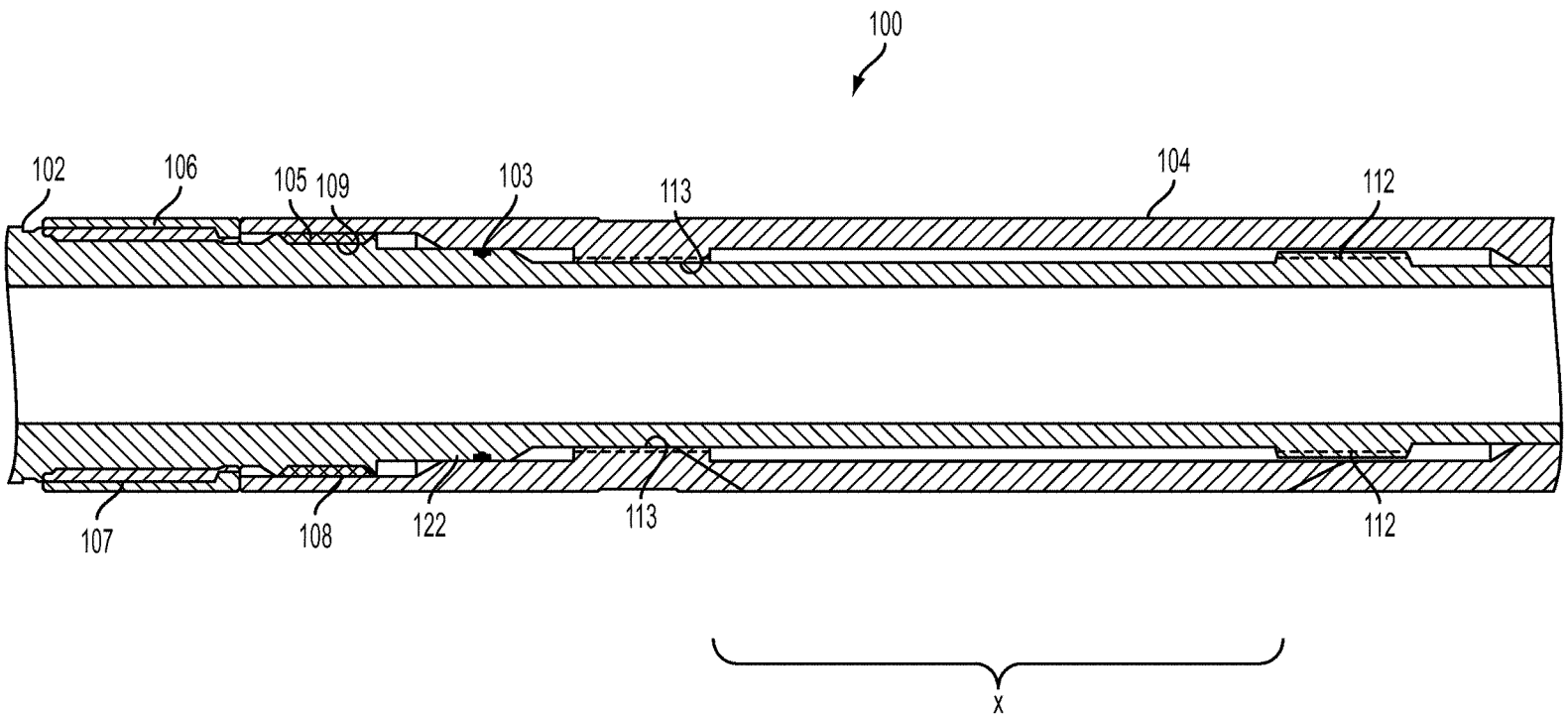
FIG. 2 is a zoomed-in view of part of the safety joint of FIG. 1.

Once the first set of threads 108 have been disengaged the string may be lifted (for example, moving the upper and lower subs 102, 104 apart longitudinally) a predetermined distance (e.g., distance "x" in FIG. 2) until a second set of threads 110 begin to engage, as shown in FIG. 3A. This movement of the sub 102 relative to the sub 104 may be referred to as a transition state. In the transition state, neither the first set of threads 108 nor the second set of threads 110 are engaged.

At least two methods may be implemented for determining disengagement of the upper threads. For example, an outer diameter to inner diameter seal (e.g., the seal created by the seal member 103) may be broken once the upper threads are fully disengaged. If isolation between the tubing and annulus is still intact, a small applied pressure on either side gives an indication of thread disengagement when pressure equalization. That is, if a slight pressure on an annular or bore side of the seal is applied and the pressure between the two sides equalizes, then the disengagement may be determined.

Additionally, if pressure isolation is no longer intact before disengagement, a slight overpull can be applied to the string while turning the upper sub 102 in the direction of disengagement (e.g., to the left). When the first set of threads 108 disengage, a bobble may be visible and the overpull (tension) should fall off or decrease. Further, there is a predetermined distance of travel (e.g., distance "x") between the threads 112, 113 of the second set of the threads 110 that allows this indication to be visible at surface. As the second set of threads 110 engage, the overpull can be seen again.

At this stage in the process (upon disengagement of the first set of threads 108) one or more of several design features can be used to help ensure centralization for the second set of threads 110. In an example embodiment, a longer, thicker bore 122 may be used on the upper sub 102. The thicker bore 122 may be seen in FIGS. 1-3. Generally, the thicker sub 122 maintains a close fit between the outer diameter of the upper sub 102 and an inner diameter of the lower sub 104. The thicker bore 122 may nearly contact the thread 113 of the lower sub 104 when in a RIH position.

Figure 4A:
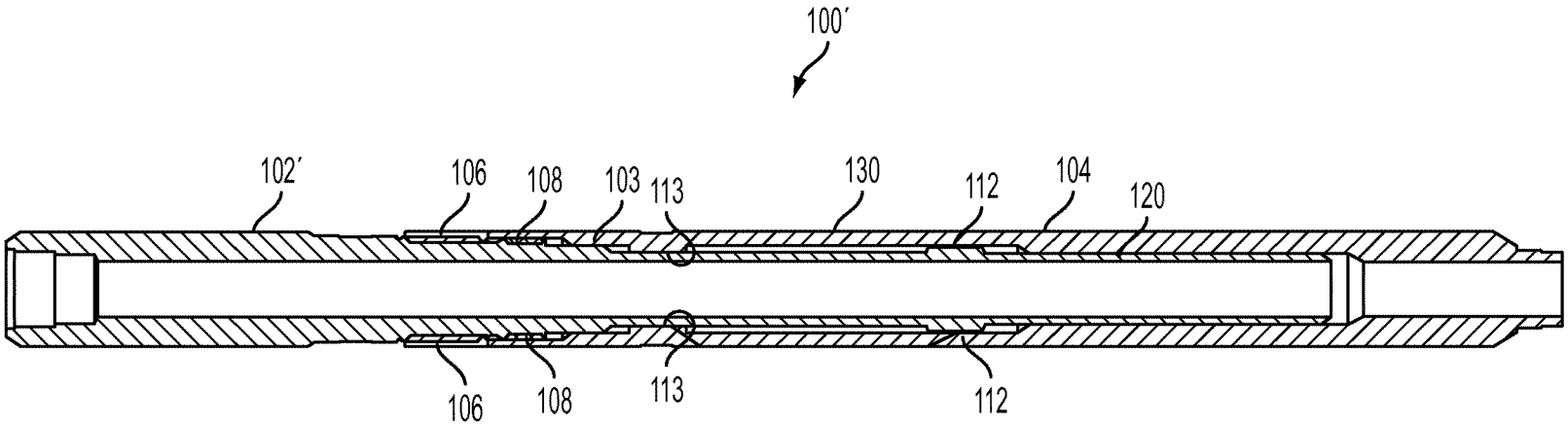
FIG. 4A is a cross-sectional view of a safety joint in a run in hole configuration in accordance with another example embodiment.

In another embodiment, illustrated in FIGS. 4A and 4B, the safety joint 100' may include a long bore 120 extending below the threads 112 on the upper sub 102' for centralization. Generally, the long rod and bore 120 maintain contact between the upper sub 102' and the interior sidewalls of the lower sub 104 below the threads 112, as shown in FIGS. 4A and 4B.

Figure 3:
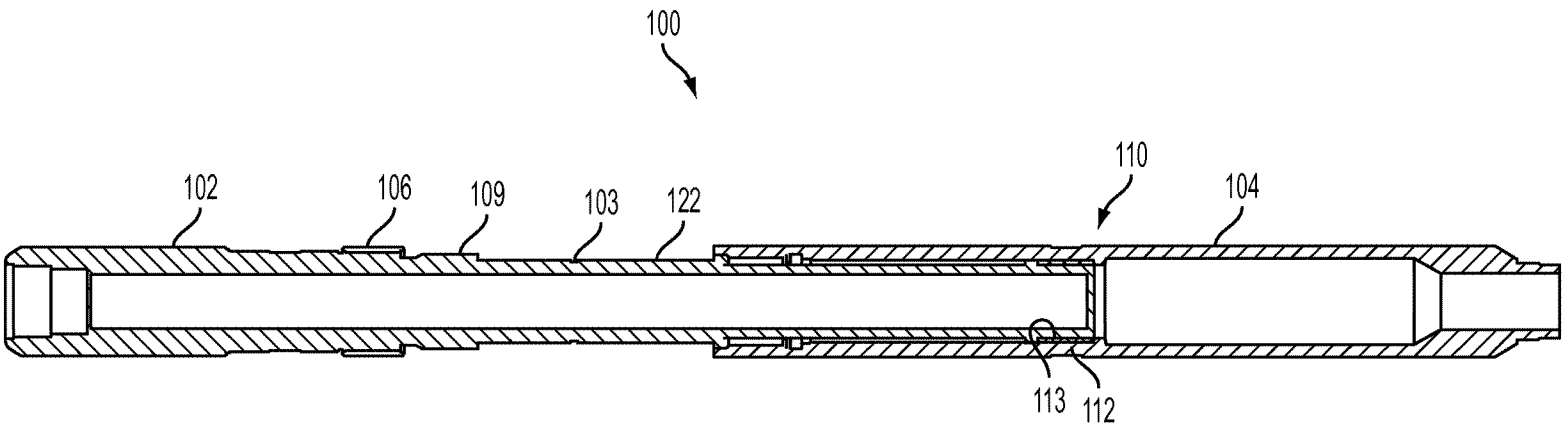
FIG. 3 illustrates the safety joint of FIG. 1 in a semi-engaged state in accordance with an example embodiment.
Figure 4B:
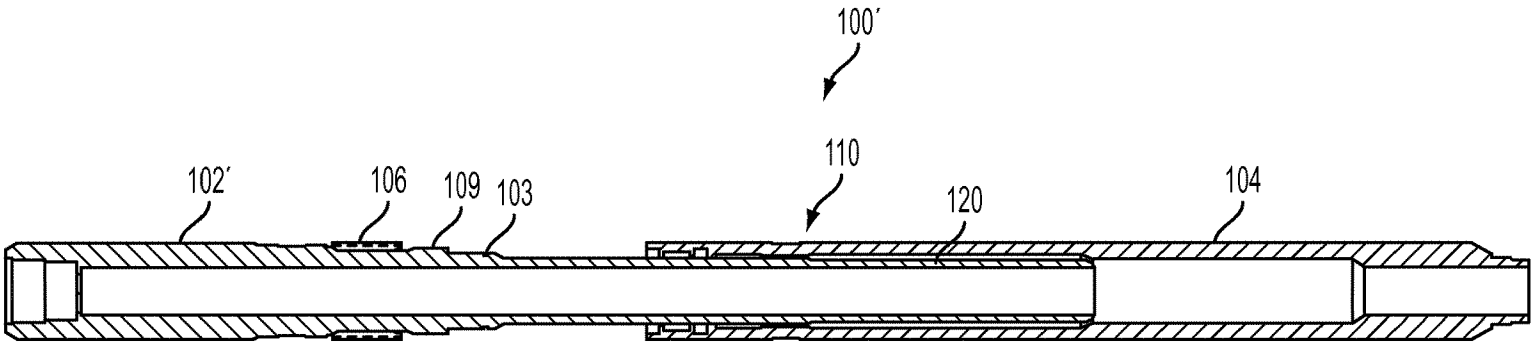
FIG. 4B illustrates the safety joint of FIG. 4A in a semi-engages state in accordance with an example embodiment.

FIGS. 3 and 4B illustrate the respective safety joints 100, 100' in a semi-engaged state, as the second set of threads 110 are engaged. The string may be turned to the right a set number of times to disengage the upper sub 102 from the lower sub 104. In some embodiments, the number of rotations to disengage the first set of threads may differ from that to disengage the second set of threads. For example, in one embodiment, the number of rotations to disengage the second set of threads 110 may be double the number of turns used to disengage the first set of threads 108. In other embodiments, the reverse may be true. It should be appreciated that other multiples of rotations may be employed in other embodiments. Additionally, in some embodiments, the rotations used to disengage the second set of threads 110 (or the first set of threads 108 in some embodiments) may retighten connections in the string that may have been loosened.

After the rotations to disengage the second set of threads 110, the overpull and extra string weight may again fall off and the string is fully disengaged, free to retrieve to surface. The remaining lower sub 104 can be fished in a suitable manner. For example, it may be fished with an overshot, or with a fishing tool that matches the internal thread (e.g., a right handed thread in some embodiments).

To assemble the tool, the torque ring 106 may be threaded to the upper sub 102 until it shoulders. The upper sub 102 may be inserted into the lower sub 104 until the second set of threads 110 engage. A predetermined number of turns (e.g., to the left) may allow the second set of threads 110 to engage and then pass each other and the upper sub 102 will be free floating within the lower sub 104. Pushing the upper sub 102 a set distance x deeper into the lower sub 104 allows the first set of threads 108 to engage. A predetermined number of turns (e.g., to the right) fully engages these threads. A small gap between the lower sub 104 and the torque ring 106 may remain. Proper alignment may be aided by an alignment v-notch machined on the upper sub 102. The torque ring 106 may be turned (e.g., to the right) until it shoulders with the lower sub 104. The connection between the torque ring 106 and the lower sub 104 may be torqued to a predetermined amount, sufficiently below a minimum torque of the rest of the string. A slight recess (decrease in the outer diameter) on the upper sub 102 near the torque ring 106, as well as a wide torque ring, may remove interference with the upper sub 102 during torqueing and may allow for a proper amount of torque to be applied via a torque machine.

A discussed above, embodiments may use a screw release. Opposing threads and sequential steps are implemented to operate the tool and reduce the likelihood of accidental release. For correct functioning, the tool is manipulated in a specific order. In some embodiments, the order is left hand turns, then lift, and then right hand turns.

The introduction of a specific process to disengage the tool reduces the likelihood of an accidental back off. The embodiments use no matched pieces, so all parts are interchangeable, decreasing the amount of waste from corrosion or thread damage. In some embodiments, the seal may be moved closer to the opening of the inner diameter of the lower sub 104 for easier cleaning and inspection. Unlike other rotational release designs, the present embodiments include no shear screws or pins.

Variations could involve the seal placement or the addition of another seal for redundancy. Seal placement may be either below the thread 112, between the threads 112, 113 of the second set of threads 110, or between the threads 109 and the torque ring 106. The seal 103 may be between the upper and lower subs 102, 104, sealing the bore from the exterior of the safety joint 100.

An additional variation that may be implemented to reduce the impact the second set of threads 110 are exposed to prior to engagement is the introduction of an oil chamber with an orifice for controlled release of the oil. The oil chamber may be implemented by putting a static seal and a dynamic seal on either side of the second set of threads 110 with an orifice that releases oil to either the outer diameter or inner diameter of the tool 100. For example, in one embodiment, the oil chamber may be located at 130 in FIG. 4A. As the first set of threads 108 are released and the lower threads move towards each other, the oil chamber may be compressed. Since the orifice releases the oil at a controlled rate, the oil will dampen the speed of the relative moment of the housings, thereby reducing the impact the second set of threads 110 see prior to reengagement.

A variation may be used in which the threads were reversed. In this scenario the second set of threads 110 would be right handed, the first set of threads 108 would be left handed and the thread for the torque ring 106 would be right handed.

Dimensions such as the housing length, outer diameter, inner diameter, thread length, thread type and material selection are all adjustable depending on the application of the tool. That is, for example, the threads may take any suitable form. In some embodiments, a coarse thread may be employed, such as two le a 2 pitch ACME coarse thread with a blunt start on each end. This may be used for both strength and ease of engagement of the sets of threads. In some embodiments different thread coarseness may be employed between the first and second sets of threads 108, 110.

While the present disclosure has been presented with respect to a limited number of embodiments, those skilled in the art, having the benefit of this disclosure, will appreciate numerous modifications and variations there from. It is intended that the appended claims cover such modifications and variations as fall within the spirit and scope of the disclosure.

What is claimed is:

1. A safety joint deployable in a well, the safety joint comprising:
- a first sub; and
- a second sub coupled to the first sub, wherein the coupling comprises:
  - a first set of threads having a first orientation; and
  - a second set of threads having a second orientation different from the first set of threads, wherein the first sub is decoupleable from the second sub upon disengagement of the first set of threads by rotation in a first direction followed by disengagement of the second set of threads by rotation in a direction opposite from the first direction;
- a fully coupled state wherein the first set of threads are coupled together and a torque ring is coupled between the first and second sub; and
- a transition state wherein the first set of threads are uncoupled, one of the first sub and the second sub remains at least partially within the other, and the second set of threads are not in contact with each other; and
- a semi-coupled state wherein the second set of threads are engaged.

2. A safety joint deployable in a well, the safety joint comprising:
- a first sub; and
- a second sub coupled to the first sub, wherein the coupling comprises:
- a first set of threads having a first orientation; and
- a second set of threads having a second orientation different from the first set of threads, wherein the first sub is decoupleable from the second sub upon disengagement of the first set of threads by rotation in a first direction followed by disengagement of the second set of threads by rotation in a direction opposite from the first direction; and
- a torque ring coupled between the first and second sub.

3. The safety joint of claim 2, wherein a threading of the torque ring is opposite to that of the first set of threads.

4. The safety joint of claim 2, wherein the first sub comprises a recess into which the torque ring is positioned.

5. A safety joint deployable in a well, the safety joint comprising:
- a first sub; and
- a second sub coupled to the first sub, wherein the coupling comprises:
  - a first set of threads having a first orientation;
  - a second set of threads having a second orientation different from the first set of threads, wherein the first sub is decoupleable from the second sub upon disengagement of the first set of threads by rotation in a first direction followed by disengagement of the second set of threads by rotation in a direction opposite from the first direction; and at least one sealing member coupled between the first and second subs.

6. A safety joint deployable in a well, the safety joint comprising:

a first sub; and a second sub coupled to the first sub, wherein the coupling comprises:

a first set of threads having a first orientation;

a second set of threads having a second orientation different from the first set of threads, wherein the first sub is decoupleable from the second sub upon disengagement of the first set of threads by rotation in a first direction followed by disengagement of the second set of threads by rotation in a direction opposite from the first direction; and a centralizing feature.

7. The safety joint of claim 6, wherein the centralizing feature comprises an extension on the first sub beyond the second set of threads, the extension maintaining contact between an out diameter of the first sub and an inner diameter of the second sub.

8. The safety joint of claim 6, wherein one of the first and second sub is at least partially inside the other and an outer diameter of the inner sub is in contact with the inner diameter of the other sub along a length of the inner sub between the first set of threads and the second set of threads.

9. A method of uncoupling a safety joint comprising:

rotating a first sub of the safety joint in a first direction to detach a first set of threads;

displacing the first sub relative to a second sub of the safety joint engaging a second set of threads;

rotating the first sub in a second direction opposite of the first direction to detach the second set of threads; and bringing a string in which the safety joint is coupled to a neutral point where there is little tension in the string.

10. The method of claim 9 further comprising overcoming a torque member.

11. The method of claim 10, wherein overcoming the torque member comprises rotating the first sub in the second direction.

12. A method of uncoupling a safety joint comprising:

rotating a first sub of the safety joint in a first direction to detach a first set of threads;

displacing the first sub relative to a second sub of the safety joint engaging a second set of threads;

rotating the first sub in a second direction opposite of the first direction to detach the second set of threads; and further comprising determining the first set of threads is detached.

13. The method of claim 12, wherein determining the first set of threads is detached comprises detecting a pressure equalization between the interior of the safety joint and the exterior of the safety joint.

14. The method of claim 12, wherein determining the first set of threads is detached comprises, upon applying an overpull, detecting at least one of:

a bobble on the string;

displacement of the string a determined distance; and decrease in the overpull followed by return to previous overpull state.

15. A method comprising:

installing a safety joint into a tool string;

running the tool string in-hole;

separating the tool string at the safety joint, wherein separating comprises:

disengaging a first set of threads by rotating an upper portion of the string in a first direction;

displacing the upper portion of the string a determined distance longitudinally from a lower portion of the string; and disengaging a second set of threads by rotating an upper portion of the string in a second direction opposite thereto of the first direction;

retrieving the upper portion of the string with a portion of the safety joint;

fishing the lower portion of the string, wherein fishing comprises:

running a fishing tool in hole;

engaging threads of a remaining portion of safety joint with threads of the fishing tool; and pulling out the lower portion of the string with the remaining portion of the safety joint.

* * * * *